United States Patent [19]

Nicholas et al.

[11] 4,375,353

[45] Mar. 1, 1983

[54] HEATER FOR CATALYTIC TYPE PROPANE OR ORGANIC GAS DETECTOR

[75] Inventors: Merle E. Nicholas, Minneapolis; James J. Renier, Hamel, both of Minn.

[73] Assignee: Honeywell Inc., Minneapolis, Minn.

[21] Appl. No.: 196,882

[22] Filed: Oct. 14, 1980

[51] Int. Cl.[3] ..... F23N 5/24; G08B 17/10

[52] U.S. Cl. ..... 431/13; 431/16; 165/47; 340/633; 422/95; 422/98

[58] Field of Search ..... 431/13, 16, 22; 340/632, 633, 634; 422/95, 98; 122/33

[56] References Cited

U.S. PATENT DOCUMENTS

| | | | |
|---|---|---|---|
| 2,508,588 | 1/1947 | Waltman | 431/22 |
| 2,535,950 | 10/1950 | Page | 422/95 |
| 2,672,533 | 3/1954 | Berger et al. | 340/633 |
| 2,891,610 | 6/1959 | Wolff | 431/22 |
| 3,854,454 | 12/1974 | Lazaridis | 122/33 |
| 4,013,943 | 3/1977 | Chou et al. | 422/98 X |
| 4,245,978 | 1/1981 | del Valle | 431/22 X |

*Primary Examiner*—Samuel Scott
*Assistant Examiner*—Carl Price
*Attorney, Agent, or Firm*—Omund R. Dahle

[57] ABSTRACT

In a catalytic type propane gas or organic gas detector there is provided a heater for the catalyst of the heat pipe type. One end of the heat pipe is in the flame of the standing pilot and the other end is in contact with the catalyst so that the waste heat from the pilot flame is used to maintain the catalyst at an elevated temperature.

8 Claims, 2 Drawing Figures

HEATER FOR CATALYTIC TYPE PROPANE OR ORGANIC GAS DETECTOR

BACKGROUND AND SUMMARY OF THE INVENTION

In recent years there has been an increased interest in catalysts for propane leak detection. Since propane is heavier than air and tends to collect in pockets, along floors, and the like, it is necessary to promptly sense the presence of the leaking propane, to foreclose the chance of a gas build up resulting in an explosion. Catalytic detectors have been known for the detection of propanes and other hydrocarbons. The catalysts must be maintained at an elevated standby temperature (such as 300° C.) in order to be efficient in operation. This has been accomplished in the past by the use of electric heating coils around the catalyst. When propane is in the presence of the catalyst a reaction occurs which causes the catalyst to be heated to a temperature higher than the standby temperature. This change in temperature can be recognized as indicating the presence of the gas.

In the present invention there is disclosed the use of a heat pipe for conveying waste heat from a standing pilot flame to the catalyst so that no electrical or other energy source need be expended in maintaining the standby temperature of the catalyst. A heat pipe is generally defined as a heat transfer device consisting of a sealed metal tube with an inner lining of wicklike capillary material and a small amount of fluid in a partial vacuum; heat is absorbed at one end by vaporization of the fluid and is released at the other end by condensation of the vapor.

DETAILED DESCRIPTION

Figure 1:
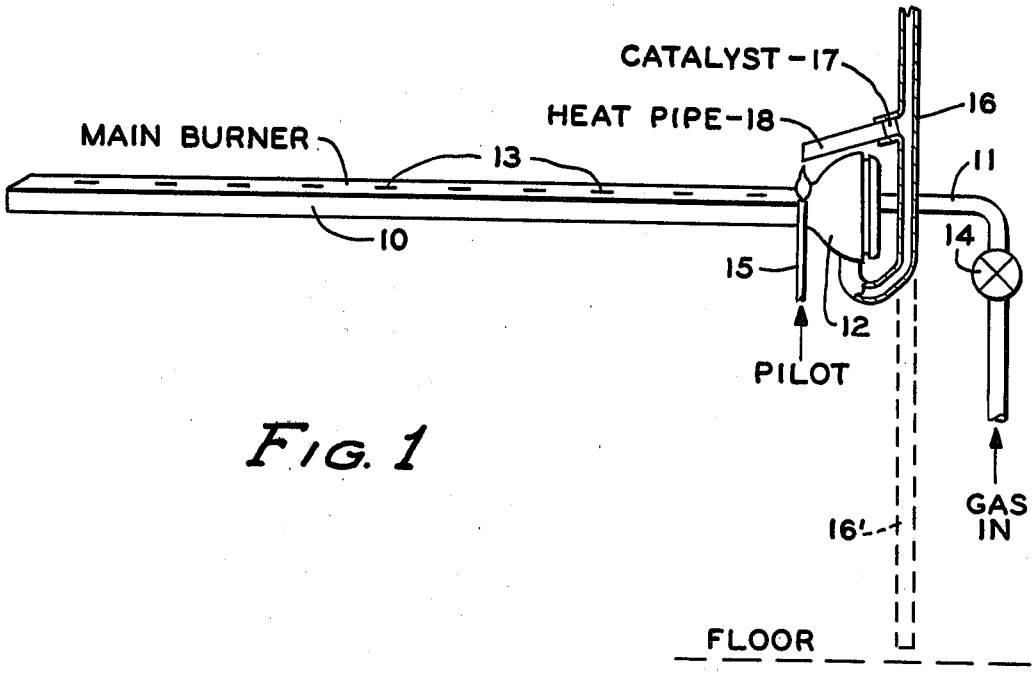
FIG. 1 is a pictorial representation of the invention as applied to a burner in a furnace.

Referring now to FIG. 1 there is shown a main burner 10 such as is common in gas furnaces, water heaters and the like. The burner 10 has a gas inlet line 11, an air mixing chamber 12 and a series of ports 13 along the length of the burner. A valve 14 is in the gas inlet line. A conventional standing pilot 15 is mounted near a port of the burner 10. From an opening in the bottom of the mixing chamber 12 a flue or tubing 16 connects upwardly to catalyst 17 and to the atmosphere. A heat pipe 18 which has one end in contact with the catalyst 17 has its opposite end heated by the flame of standing pilot 15 and in turn the heat pipe maintains the catalyst in a heated state. In one successful embodiment the catalyst was maintained at a standby temperature of about 300° C. The embodiment of FIG. 1 uses the heat of the catalyst in a chimney draft effect to effectively pull the air or gas up through flue 16 and over the catalytic surface. Although the specific embodiment shown in FIG. 1 is to sense the leaky valve 14 situation in which valve 14 leaks when in the off position and the leaking gas spills out of pipe 11 falling to the bottom of the mixing chamber 12, the sensor may also be used to detect propane gas collecting near the base of the furnace, by directing the sensing flue 16 downwardly as shown in the dashed line at 16'. This variation may also be accomplished by providing a "Y" in the sensing flue 16 so that the convection current through the catalyst can be drawn from both chamber 12 and through section 16'.

Figure 2:
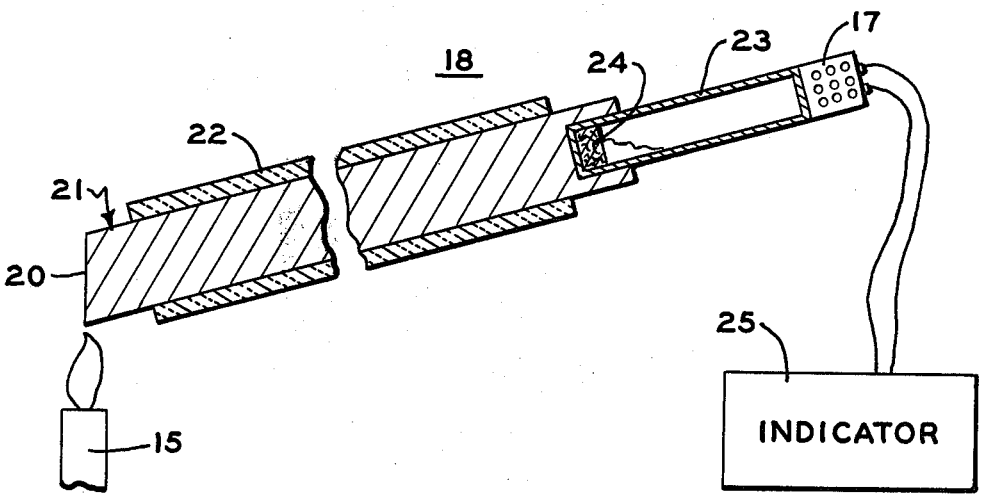
FIG. 2 is an enlarged view of a portion of FIG. 1.

The construction of the heat pipe is shown in more detail in FIG. 2. While it is the object of heat pipe 18 to conduct heat from the flame to the catalyst 17, the gas pilot light can provide temperatures in excess of 700° C. while the catalytic bed should be heated to and maintained at a temperature in the range of approximately 300°–350° C. The disparity in temperatures between the pilot light and the catalyst is accommodated by the heat pipe assembly. Again the flame of pilot 15 heats the tip 20 of the heat pipe 18, the heat conductor section 21 preferably being constructed of a stainless steel rod which exhibits both excellent chemical stability in the environment of continuous flame and relatively limited heat conductivity. Rod 21 may be surrounded by cylindrical insulator 22, if desired, to prevent gross variations in BTU transfer that could be created by changes in air flow or air temperature at this location.

Adjacent to the stainless steel section 21 of heat pipe 18 there is a tubular chamber section 23 in which the fill is mercury and nitrogen gas. Other fills may be chosen if desired. Mercury boiling at 356° C. with a nitrogen gas fill provides a good choice of liquid for the chamber section as many useable catalysts operate at this temperature. Mercury at this desired temperature of operation can be easily handled in a sealed steel tube. The heat pipe 18 can be slightly tilted such that the condensing mercury drains back to the left to wick 24 where it is raised in the wick into the heated end for reboiling.

In operation the heat transferred through the stainless steel rod 21 is limited because of the limited heat conductivity so that in the filled tube 23 the process of boiling mercury at the left end and conveying the heat to the right end where mercury condensation occurs is a continuous process. In this way a stable temperature of the catalyst is maintained during standby conditions. The dimensions of cross section and length of the rod 21 to achieve the right transfer of heat to the tube 23 can be calculated from the general equation:

$$H = kAt(\Delta T/L) \quad (1)$$

where

H is a measure of BTU k = thermal conductivity of stainless steel

A = cross section ($ft^2$) of stainless rod t = time (hours)

$\Delta T$ = temperature gradient (°F.) opposite ends of rod

L = length of stainless rod (ft).

In one embodiment the material chosen for rod 21 is the 300 series stainless steel.

The catalyst structure may be of the honeycomb type with a thermocouple in the structure to provide an electrical signal output on thermocouple leads 19 which signal magnitude is a function of catalyst temperature. When propane reaches the catalyst the temperature of the catalyst rises rapidly. An indicator circuit 25 attached to leads 19 may sense either rate-of-rise or absolute temperature. In one laboratory experiment to demonstrate sensitivity of the gas detector, a calibrated leak of 0.5 cubic centimeter/second injected at inlet gas line 11 and where the standby catalyst temperature had been 300° C., provided a fast response time of only 8 seconds. Although the specific embodiment has been described as an improved sensor apparatus for detecting the presence of propane, it is clear that the teachings are applicable for organic gases.

The embodiments of the invention in which an exclusive property or right is claimed are defined as follows:

1. A heat pipe type heater for a catalytic gas detector, the apparatus comprising:

a catalytic gas detector requiring a source of heat for maintaining the catalyst at an elevated temperature; and, heat pipe means for transferring heat to said catalyst from a standing flame of a gas burner means with said flame adapted to ignite fuel from a main burner means to thereby maintain said catalyst at said elevated temperature, said heat pipe means having one end thereof proximate the flame and heated thereby, said heat pipe means having the other end thereof in heat transferring relation to the catalyst.

2. Apparatus according to claim 1 wherein the standing flame is the flame of a standing pilot for igniting said main burner.

3. Apparatus according to claim 1 wherein said heat pipe means comprises a stainless steel rod portion joining a sealed metal tube portion which contains a small amount of fluid.

4. In a gas burner appliance of the type having a standing pilot, apparatus for utilizing waste heat from the standing pilot flame to heat a catalyst to an activation temperature, the apparatus comprising:

a catalytic gas detector in which a catalyst requires being maintained at an elevated activation temperature;

heat pipe means positioned for transferring heat from a standing pilot flame to said catalyst to thereby maintain said catalyst at said elevated activation temperature;

said heat pipe means comprising a metal rod of a material having limited heat transfer capabilities for reducing the heat received from the flame to a substantially lower temperature at the other end, the heat pipe means further comprising a sealed metal tube portion which contains an amount of liquid which has a boiling point approximately the same as said elevated activation temperature.

5. Apparatus according to claims 3 or 4 wherein the fluid is mercury.

6. Apparatus according to claims 1 or 4 and further comprising:

a temperature detector at said catalyst providing an electrical output signal which is a function of the temperature of the catalyst; and, indicator means providing an indication of said electrical output signal.

7. Apparatus according to claim 4 for sensing minute quantities of gas leaking into a gas burner, the apparatus further comprising:

flue means containing said heated catalytic gas detector, a lower end of said flue means being connected to said burner to draw air therefrom and pass it across said catalyst.

8. Apparatus according to claims 1 or 4 for sensing the accumulation of gas leaking into an area, the apparatus further comprising:

flue means containing said heated catalytic gas detector, said heated detector causing a current of air to rise through said flue means, the lower end of said flue means being positioned where it is expected leaking gas may accumulate.

* * * * *